US009269260B2

(12) United States Patent
Lampert et al.

(10) Patent No.: US 9,269,260 B2
(45) Date of Patent: Feb. 23, 2016

(54) METHOD AND SYSTEM TO INCREASE PROTECTION OF PERSONNEL DURING K9 DEPLOYMENTS

(71) Applicant: MOTOROLA SOLUTIONS, INC, Schaumburg, IL (US)

(72) Inventors: Chet A. Lampert, Sunrise, FL (US); Alejandro G Blanco, Fort Lauderdale, FL (US); Melanie A. King, Hollywood, FL (US)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 125 days.

(21) Appl. No.: 14/261,973

(22) Filed: Apr. 25, 2014

(65) Prior Publication Data

US 2015/0310729 A1 Oct. 29, 2015

(51) Int. Cl.
*G08B 27/00* (2006.01)
*G08B 25/01* (2006.01)

(52) U.S. Cl.
CPC ..... *G08B 27/001* (2013.01); *G08B 25/016* (2013.01)

(58) Field of Classification Search
CPC ..... G08B 27/001; G08B 25/016
USPC ..... 340/539.11
See application file for complete search history.

(56) References Cited

U.S. PATENT DOCUMENTS 6,067,018 A 5/2000 Skelton et al.
6,700,492 B2 3/2004 Touchton et al.
6,882,307 B1 4/2005 Gifford
7,710,263 B2 5/2010 Boyd
8,531,293 B2 9/2013 Putz
8,543,134 B2 9/2013 Lopez et al.
8,630,820 B2 1/2014 Amis
2008/0173257 A1 7/2008 Steiner et al.
2009/0018875 A1 1/2009 Monatesti
2009/0021367 A1 1/2009 Davies
2012/0006282 A1 1/2012 Kates
2013/0060351 A1 3/2013 Imming
2013/0092099 A1* 4/2013 Hardi ..... A01K 29/005 119/721
2013/0244687 A1 9/2013 Stargardt
2014/0230755 A1* 8/2014 Trenkle ..... A01K 27/009 119/859
2015/0053144 A1* 2/2015 Bianchi ..... A01K 15/021 119/720

FOREIGN PATENT DOCUMENTS

FR WO2012/172183 * 12/2012 ..... A01M 31/002
WO 2012000107 A1 1/2012

* cited by examiner

*Primary Examiner* — Jennifer Mehmood
*Assistant Examiner* — Omar Casillashernandez
(74) *Attorney, Agent, or Firm* — Daniel R. Bestor

(57) ABSTRACT

Methods and systems to increase protection of personnel during K9 deployments include receiving contextual and situational data from mobile devices associated with a plurality of officers at a scene, a mobile device associated with a K9 handler at the scene, and a device associated with a K9 at the scene, wherein each of the mobile devices and the device are communicatively coupled to one or more networks; determining safety conditions of each of the plurality of officers based on the contextual and situational data; and notifying any of the plurality of officers and the K9 handler via the associated mobile devices of unsafe conditions based on the determining.

20 Claims, 6 Drawing Sheets

METHOD AND SYSTEM TO INCREASE PROTECTION OF PERSONNEL DURING K9 DEPLOYMENTS

BACKGROUND OF THE INVENTION

In law enforcement and other areas, a police dog (also referred to as a K9) is a dog trained specifically to assist police and other law enforcement personnel in their work. Most police agencies in the United States—whether state, county, or local—use K9s as a means of law enforcement. Most (if not all) police agencies with K9 units have had a K9 mistakenly attack other public safety officers that happen to be in the wrong place/wrong time. Officers are generally in fear of being bitten by the animals due to these occurrences. Based on discussions with a K9 unit in the US (including head trainers, K9 officers, and K9 SWAT members), there are numerous times when officers have been bitten unintentionally. In the United Kingdom, 196 police staff were bitten in a three year period prior to 2011. Generally, relatively newer officers forget what to do when a K9 units are on scene and about to release the animal. For example, officers either forget or get tunnel vision and chase a suspect when they should know a K9 is or is about to be on the scene. Other instances happen on leash when newer officers get in front and too close to the animal when it is on a scent and on leash. Officers are generally "terrified" of the animals and this fear usually keeps them safe. Other instances of biting are when civilians unexpectedly pop out in front of the animals when the animals are locked onto a scent.

Accordingly, there is a need for a method and system to increase protection of personnel during K9 deployments.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
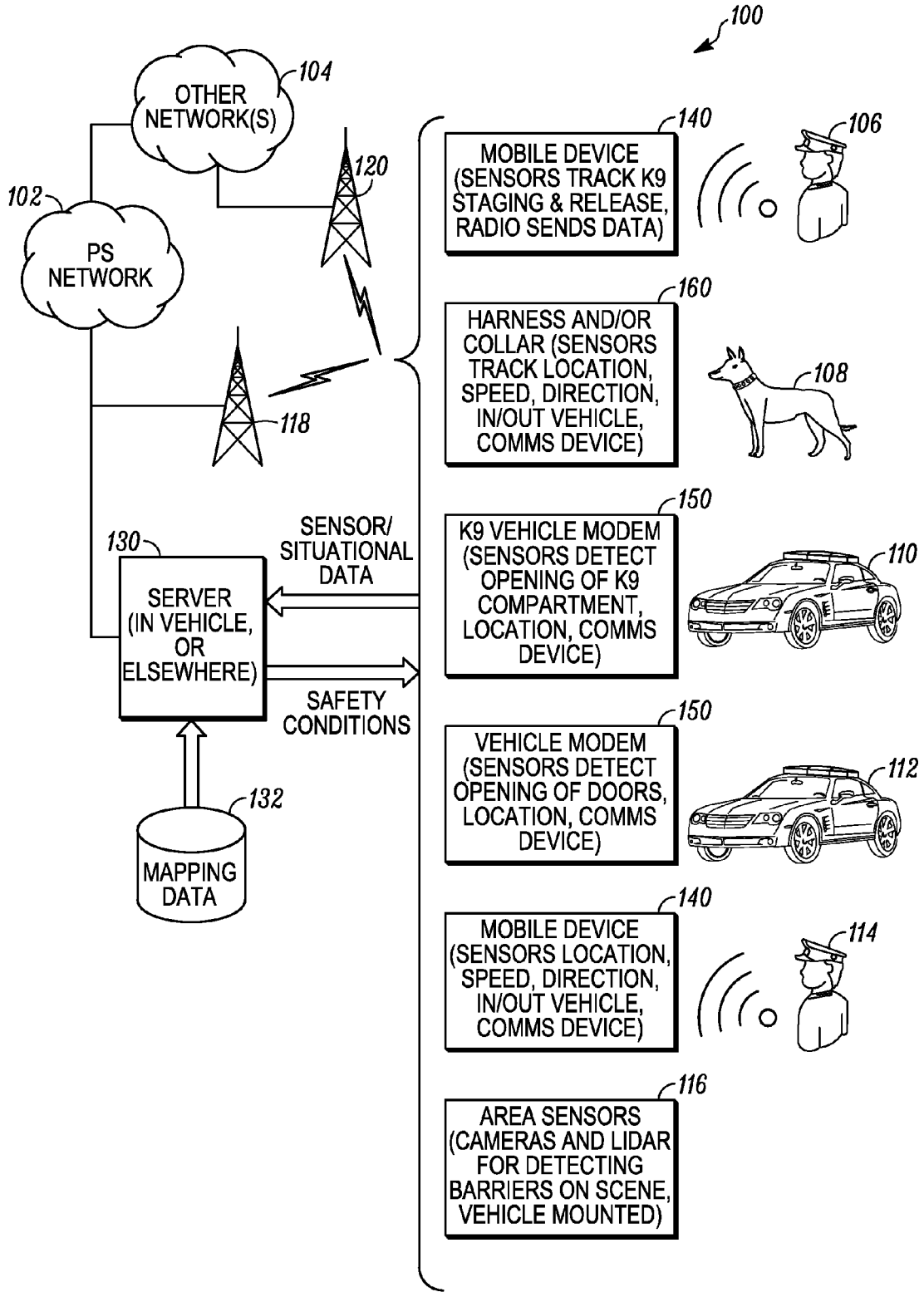
FIG. 1 is a network diagram of a network for the methods and systems to increase protection of personnel during K9 deployments in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

In various exemplary embodiments, methods and systems to increase protection of personnel during K9 deployments are described. The methods and systems utilize situational and context awareness to determine when personnel may be in danger of being on the path of a K9. As described herein, personnel can include any public safety personnel communicating on a public safety and/or private network such as police officers, K9 handlers, etc. The methods and systems can alert personnel when he/she exits a safe condition and a K9 is off-leash or out of car without leash (automatic door of K9 vehicle deployed), and the like. The methods and systems can also alert a K9 handler that an officer on scene is out of the safe condition so that K9 handler does not release the animal or calls the animal back if already released and appropriate.

In an exemplary embodiment, a method to increase protection of personnel during K9 deployments includes receiving contextual and situational data from mobile devices associated with a plurality of officers at a scene, a mobile device associated with a K9 handler at the scene, and a device associated with a K9 at the scene, wherein each of the mobile devices and the device are communicatively coupled to one or more networks; determining safety conditions of each of the plurality of officers based on the contextual and situational data; and notifying any of the plurality of officers and the K9 handler via the associated mobile devices of unsafe conditions based on the determining.

In another exemplary embodiment, a server includes a network interface, a data store, and a processor, each communicatively coupled therebetween; and memory storing instructions that, when executed, cause the processor to: receive, via the network interface, contextual and situational data from mobile devices associated with a plurality of officers at a scene, a mobile device associated with a K9 handler at the scene, and a device associated with a K9 at the scene, wherein each of the mobile devices and the device are communicatively coupled to the network interface through one or more networks; determine safety conditions of each of the plurality of officers based on the contextual and situational data; and notify any of the plurality of officers and the K9 handler via the associated mobile devices of unsafe conditions based on the determined safety conditions.

In yet another exemplary embodiment, a public safety network includes a plurality of mobile devices each associated with an officer; a K9 handler mobile device; a harness and/or a collar disposed to a K9; a server communicatively coupled to the plurality of mobile devices, the K9 handler mobile device, the harness and/or collar, and the vehicle modem; wherein the server is configured to: notify any of the plurality of mobile devices of an unsafe condition and associated details relative to the K9; and notify the K9 handler mobile device of any of the plurality of mobile devices being in the unsafe condition when about to release the K9 or after such that the K9 is recalled; wherein the unsafe condition is based on situational and contextual data provided by the plurality of mobile devices, the K9 handler mobile device, and the harness and/or collar to the server.

FIG. 1 is a network diagram of a network 100 for the methods and systems to increase protection of personnel during K9 deployments in accordance with some embodiments. The network 100 includes a public safety (PS) network 102, optionally one or more other networks 104, a K9 officer/handler 106, a K9 (i.e., a police service dog or canine) 108, a K9 vehicle 110, a vehicle 112, one or more officers 114, and area sensors 116. The PS network 102 can include one or more access points 118 and the one or more other networks 104 can include one or more access points 120. The access points 118, 120 can include base stations, evolved node B's (eNB), access terminals, repeaters, and the like, and the access points 118, 120 generally provide wireless connectivity on the networks 102, 104. The PS network 102 can utilize, for example, Long Term Evolution (LTE), Enhanced Voice-Data Optimized (EVDO), IEEE 802.11 and variants thereof ("Wi-Fi"), Project 25 (P25), Digital Mobile Radio (DMR), Land Mobile Radio (DMR), Terrestrial Trunked Radio (TETRA), etc. The one or more networks 104 can include LTE, EVDO, Wi-Fi, etc. In an exemplary embodiment, the one or more networks 104 can include commercial wireless provider networks. The networks 102, 104 are described herein for illustration purposes, and those of ordinary skill in the art will recognize the methods and systems contemplate operation with any wireless or mobile network configuration.

Figure 3:
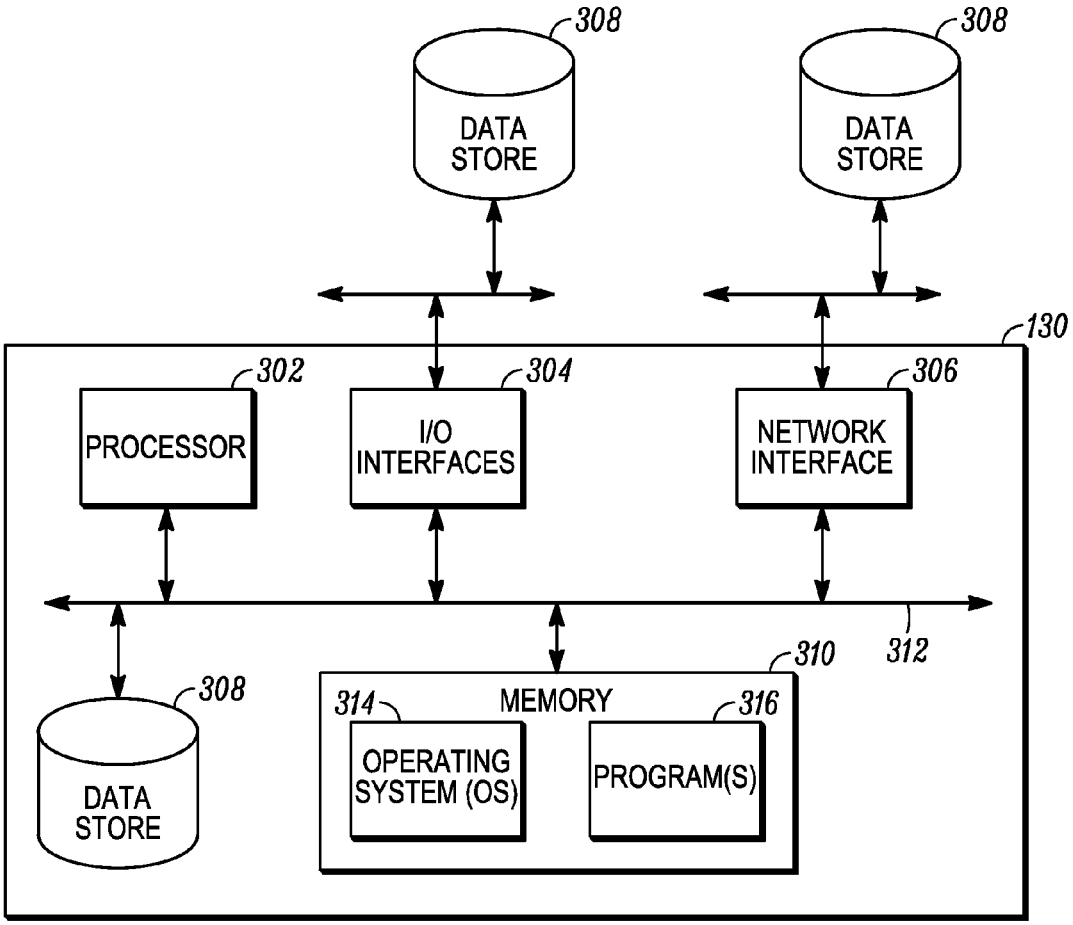
FIG. 3 is a block diagram of a server in the network of FIG. 1 in accordance with some embodiments.
Figure 4:
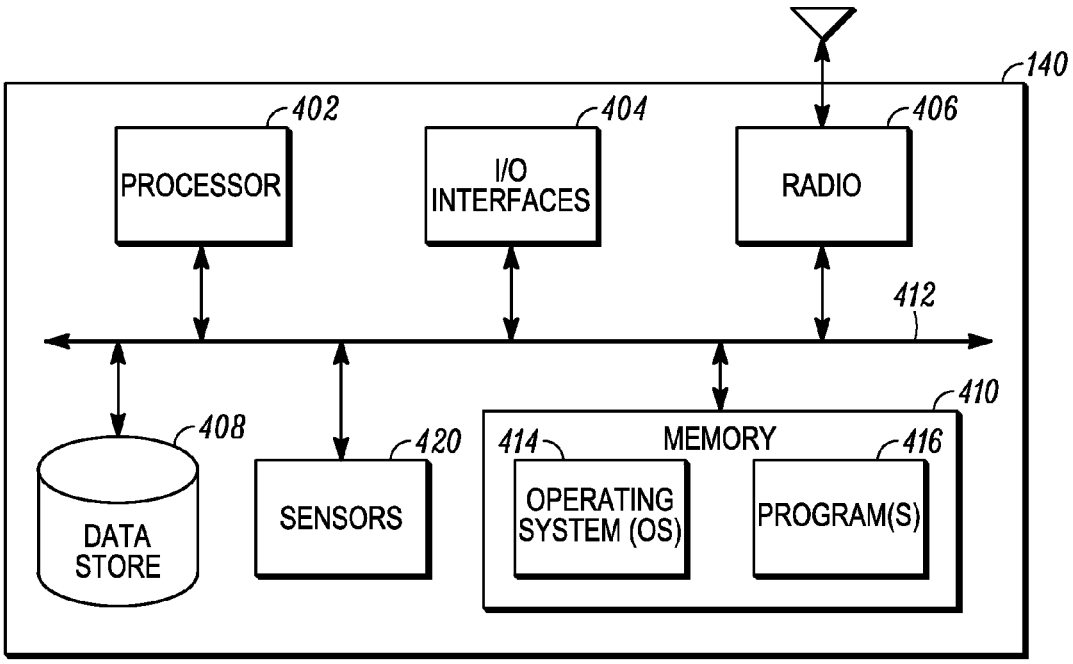
FIG. 4 is a block diagram of a mobile device in the network of FIG. 1 in accordance with some embodiments.

The network 100 can include a server 130 with mapping data 132, and the server 130 can be communicatively coupled to the networks 102, 104 to provide a central or distributed controller for the methods and systems described herein. Note, while illustrated in FIG. 1 as a separate device, the server 130 can be distributed between various devices with the users, in various devices in vehicles, etc. An exemplary implementation of the server 130 is illustrated in FIG. 3. The K9 officer/handler 106 and the one or more officers 114 can have a mobile device 140 that is communicatively coupled to the PS network 102 and/or the one or more networks 104. The vehicles 110, 112 can include a vehicular modem (VM) 150 which is communicatively coupled to the PS network 102 and/or the one or more networks 104. The K9 108 can include a harness and/or collar 160 that is communicatively coupled to the PS network 102 and/or the one or more networks 104. For example, the harness and/or collar 160 can be physically attached to the K9 108 such as via a collar on the K9 108 or the like. An exemplary implementation of the mobile device 140, the VM 150, and the harness and/or collar 160 is illustrated in FIG. 4. The area sensors 116 can also be communicatively coupled to the PS network 102 and/or the one or more networks 104. The area sensors 116 can be fixed such as cameras and Light Detection and Ranging (lidar) as well as mobile such as mounted in the vehicles 110, 112. The area sensors 116 provide situational data across a geographical location or scene, along with data from the mobile device 140, the VM 150, and the harness and/or collar 160.

Collectively, the networks 102, 104 provide public safety communication between the various users (the K9 officer/handler 106, the vehicles 110, 112, and the one or more officers 114) and their associated devices (the mobile devices 140 and the vehicle modems 150). The methods and systems described herein also include the harness and/or collar 160 on the K9 108 to provide context and situational awareness related to the K9 108 to the users through the server 130. Variously, the server 130 is configured to: (1) define a dynamic geofence based on the mapping data 132 and information from the harness and/or collar 160, the vehicle modem 150 from the K9 vehicle 110, and/or the mobile device 140 from the K9 officer/handler 106; receive context data from all of the users (the K9 officer/handler 106, the vehicles 110, 112, and the one or more officers 114) and the K9 108; and make decisions relative to the geofence and send alerts when appropriate. As described herein, the geofence is a geographic area of determined risk based on the deployment of the K9 108 (on or off-leash). That is, the geofence can be an area of risk/safety that takes into account various situational and contextual parameters based on feedback. The geofence can indicate safe areas or risk areas. The geofence can move or change over time based on feedback from the harness and/or collar 160. An objective of the methods and systems is to alert other public safety users of the determined risk based on the geofence.

The methods and systems use context and situational awareness to determine when the officers 114 may be in danger of being in the path of the K9 108. The methods and systems can alert any of the officers 114 when he/she exits a safe condition and the K9 108 is off-leash or out of the vehicle 110 without leash (e.g., automatic door of the K9 vehicle 110 deployed). The methods and systems can alert the K9 officer/handler 106 that one of the officers 114 on scene is out of the safe condition, i.e. within the geofence, so that K9 officer/handler 106 does not release the K9 108 or calls the K9 108 back if already released as appropriate. Again, the methods and systems can be implemented through various devices in the network 100 that are communicatively coupled together, and decision making could be done centrally or distributed.

A safe condition can be defined, for example, configurable and depending on the agency. The safe condition can be one or a combination of the following: (1) a condition related to the geofence, e.g. the officer 114 being located behind a barrier (barrier could be a car in a known location or any other object at known location) and/or being a defined distance behind the K9 108, the officer having a proximity to the K9 108 that is greater than defined parameter regardless of direction, based on a direction the K9 108 is moving in or projected to move in based on conditions and geography, and/or based on a direction of egress for the K9 108 out of a vehicle or other containment; (2) being inside of the vehicles 110, 112 regardless of proximity to the K9 108 (being inside of a vehicle would be considered a safe condition); (3) manual feedback that the officer 114 is in a safe condition; and/or (4) the officer 114 is not running (K9 handlers have reported that a running officer is more likely to be attacked). The various conditions in (1) related to the geofence are examples of the various situational and contextual parameters for the geofence. Also, the safe condition can be determined manually and/or automatically.

In various exemplary embodiments, the methods and systems alert the K9 officer/handler 106 and the officers 114, via their associated mobile devices 140 and in real-time, when they are in unsafe conditions relative to the K9 108 along with condition details to enable the officers 114 to be diligent or to move to the safe condition. Also, the methods and systems can only provide alerts when there is an unsafe condition to prevent inundating the K9 officer/handler 106 and the officers 114 with alerts as well as emphasizing the importance of the alert. The alert can be audio and/or visual as well as provide context details, location/maps, directions, etc.

From an operational perspective, the various devices 116, 140, 150, 160 are configured to provide sensor/situational data to the server 130 while the server 130 provides safety conditions to the various devices 116, 140, 150, 160. Again, this data exchange can be in real-time or near real-time via the networks 102, 104. Also, the server 130 can be operated as a stand-alone device (as depicted in FIG. 1) or as a distributed device operating on any of the various devices 116, 140, 150, 160 or a combination thereof. The mobile device 140 associated with the K9 officer/handler 106 can include sensors that track staging and release of the K9 108. The mobile device 140 associated with the one or more officers 114 can include sensors for location, speed, direction, and whether the officers 114 are in or out of a vehicle. The vehicle modem 150 for the K9 vehicle 110 can include sensors detecting opening of a K9 compartment along with location and direction of the vehicle 110. The vehicle modem 150 for the vehicle 112 can include sensors detecting opening of doors as well as location of the vehicle 112. Finally, the harness and/or collar 160 can include sensors tracking location, speed, direction, and whether the K9 108 is in or out of a vehicle.

Figure 2:
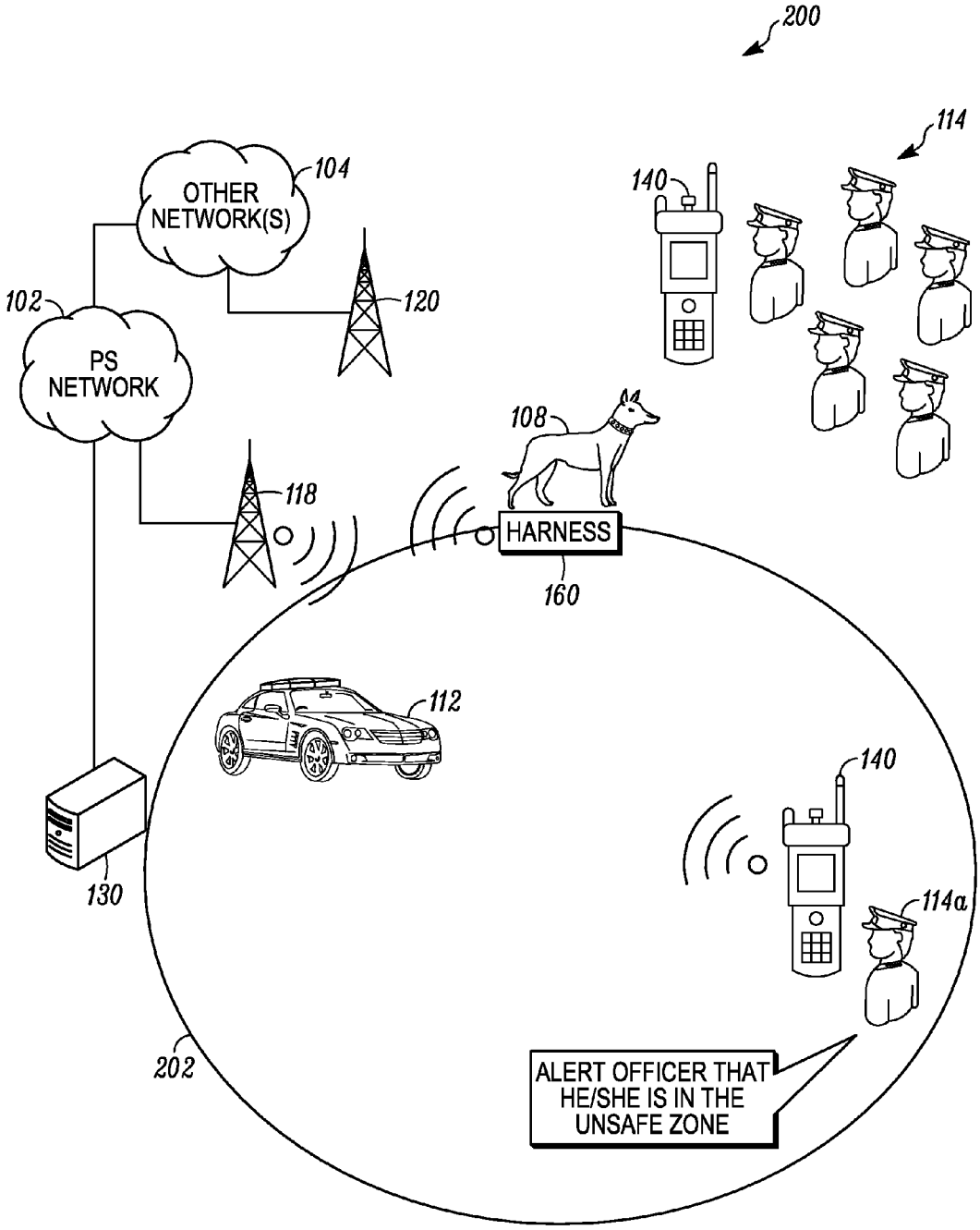
FIG. 2 is an exemplary operation of the methods and systems to increase protection of personnel during K9 deployments in accordance with some embodiments.

FIG. 2 is an exemplary operation 200 of the methods and systems to increase protection of personnel during K9 deployments in accordance with some embodiments. In the operation 200, the K9 108 is deployed and its harness and/or collar 160 is communicating on the networks 102, 104. A dynamic geofence 202 is established which is a logical area over a physical area of risk and safety based on the K9 108. In the exemplary operation 200, no alert is provided to the officers 114 inside the vehicle 112 despite the vehicle 112 being within the geofence 202 because the officers 114 are safe, i.e., within the vehicle 112 and not in danger of being attacked. If the officers 114 exit the vehicle 112, e.g., determined by the sensors in the vehicle 112 and/or by the sensors in the mobile devices 140 of the officers 114, the officers 114 are alerted of the K9 deployment as this is a situational change from being safe within the vehicle 112.

The exemplary operation 200 includes other officers 114 with their associated mobile devices 140 outside of the geofence 202 and thus safe and not alerted. However, if the definition of the geofence 202 changes such that any of the officers 114 are within the geofence 202 (e.g., based on a situational change from the K9 108), or any of the officers 114 move within the geofence 202, then the officers 114 are alerted of the K9 deployment, as this is a situational change from being safe outside the geofence 202. Finally, as depicted in FIG. 2, an officer 114*a* is within the geofence 202 and is not under any of the aforementioned safe conditions. The officer 114*a* is alerted via the mobile device 140 of the officer 114*a* that he/she is in an unsafe zone (i.e., is within the geofence 202), so that the officer 114*a* can be on the alert for the K9 108 or can change his/her situation to a safe condition (e.g., may enter a vehicle 112, may exit the geofence 202, may remain still rather than run, etc.). Again, all of the aforementioned situations can change in real-time based on the context and situational awareness of the methods and systems.

FIG. 3 is a block diagram of the server 130 in accordance with some embodiments. The server 130 may be a digital computer that, in terms of hardware architecture, generally includes a processor 302, input/output (I/O) interfaces 304, a network interface 306, a data store 308, and memory 310. It should be appreciated by those of ordinary skill in the art that FIG. 3 depicts the server 130 in an oversimplified manner, and a practical embodiment may include additional components and suitably configured processing logic to support known or conventional operating features that are not described in detail herein. The components (302, 304, 306, 308, and 310) are communicatively coupled via a local interface 312. The local interface 312 may be, for example but not limited to, one or more buses or other wired or wireless connections, as is known in the art. The local interface 312 may have additional elements, which are omitted for simplicity, such as controllers, buffers (caches), drivers, repeaters, and receivers, among many others, to enable communications. Further, the local interface 312 may include address, control, and/or data connections to enable appropriate communications among the aforementioned components.

The processor 302 is a hardware device for executing software instructions. The processor 302 may be any custom made or commercially available processor, a central processing unit (CPU), an auxiliary processor among several processors associated with the server 130, a semiconductor-based microprocessor (in the form of a microchip or chip set), or generally any device for executing software instructions. When the server 130 is in operation, the processor 302 is configured to execute software stored within the memory 310, to communicate data to and from the memory 310, and to generally control operations of the server 130 pursuant to the software instructions. The I/O interfaces 304 may be used to receive user input from and/or for providing system output to one or more devices or components. User input may be provided via, for example, a keyboard, touch pad, and/or a mouse. System output may be provided via a display device and a printer (not shown). I/O interfaces 304 may include, for example, a serial port, a parallel port, a small computer system interface (SCSI), a serial ATA (SATA), a fibre channel, Infiniband, iSCSI, a PCI Express interface (PCI-x), an infrared (IR) interface, a radio frequency (RF) interface, and/or a universal serial bus (USB) interface.

The network interface 306 may be used to enable the server 130 to communicate on a network, such as the Internet, a wide area network (WAN), a local area network (LAN), and the like, etc. The network interface 306 may include, for example, an Ethernet card or adapter (e.g., 10BaseT, Fast Ethernet, Gigabit Ethernet, 10 GbE) or a wireless local area network (WLAN) card or adapter (e.g., 802.11a/b/g/n). The network interface 306 may include address, control, and/or data connections to enable appropriate communications on the network. A data store 308 may be used to store data such as the mapping data 132. The data store 308 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 308 may incorporate electronic, magnetic, optical, and/or other types of storage media. In one example, the data store 308 may be located internal to the server 130 such as, for example, an internal hard drive connected to the local interface 312 in the server 130. Additionally in another embodiment, the data store 308 may be located external to the server 130 such as, for example, an external hard drive connected to the I/O interfaces 304 (e.g., SCSI or USB connection). In a further embodiment, the data store 308 may be connected to the server 130 through a network, such as, for example, a network attached file server.

The memory 310 may include any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory 310 may incorporate electronic, magnetic, optical, and/or other types of storage media. Note that the memory 310 may have a distributed architecture, where various components are situated remotely from one another, but can be accessed by the processor 302. The software in memory 310 may include one or more software programs, each of which includes an ordered listing of executable instructions for implementing logical functions. The software in the memory 310 includes a suitable operating system (O/S) 314 and one or more programs 316. The operating system 314 essentially controls the execution of other computer programs, such as the one or more programs 316, and provides scheduling, input-output control, file and data management, memory management, and communication control and related services. The one or more programs 316 may be configured to implement the various processes, algorithms, methods, techniques, etc. described herein.

The server 130 as illustrated in FIG. 3 is presented as a single computing device with the various components (302, 304, 306, 308, and 310) providing associated functionality and communication via the local interface 312. The server 130 can also be implemented as a cluster of servers with the functionality of the components (302, 304, 306, 308, and 310) distributed throughout multiple devices. In another exemplary embodiments, the server 130 can be physically realized in a distributed manner across various other components in the network 100. For example, the server 130 in this exemplary embodiment can be implemented in a shared, distributed manner across the mobile devices 140, the vehicle modems 150, and/or the harness and/or collar 160. In yet another exemplary embodiment, the server 130 can be implemented in one of the vehicles 110, 112 such as part of the vehicle modem 150 or in the harness and/or collar 160. Various physical implementations are contemplated for the server 130.

In an exemplary embodiment, the server 130 includes instructions for a program 316 to implement a method for notifying the K9 officer/handler 106 of co-worker unsafe conditions if the K9 108 released when the K9 108 is contained in a vehicle, on leash, or constrained in some other way. The notification may be based on location tracking data, data from sensors 116 for detecting whether an officer 114 is in/out of the vehicle 112, data from the K9 harness and/or collar 160 that detects staging and release of the K9, the mobile devices 140 tracking officer locations, data from sensors detecting opening a K9 vehicle compartment in the K9 vehicle 110, the mapping data 132 to determine layout, barriers, etc. The method for notifying the K9 officer/handler 106 can include a determination of safe-zones for the officers 114 based on, for example, a location of the K9 108 on-scene or a direction and orientation of egress of the K9 108 if containment were released (door opened, unleashing, etc.). The method can further include determination of the safety condition of the officers 114 on-scene based on a location of each of the officers 114, whether each of the officers 114 is in or out of a vehicle 112, and/or whether there are any barriers between the K9 108 and the officers 114. The server 130 is configured to cause a notification, including information about the officers 114 in non-safety condition and associated details, to be sent to the mobile device 140 associated with the K9 officer/handler 106 via the networks 102, 104. The method can include only notifying the K9 officer/handler 106 if the K9 officer/handler 106 indicates a "ready to release" state associated with the K9 108, which state can be manually indicated by the K9 officer/handler 106, can be indicated by putting the leash on the K9 108 in the vehicle 110, can be indicated by the K9 vehicle 110 stopping at the location of the incident (an indication that the K9 108 is soon to be released), or can be indicated by some other natural staging action.

In another exemplary embodiment, the server 130 includes instructions for a program 316 to implement a method for alerting one of the officers 114 of danger from the K9 108. This can include a determination of safe-zones for the officers 114 based on, for example, a location of the K9 108 on-scene or a direction and orientation of egress of the K9 108 if containment were released (door opened, unleashing, etc.). The method can also include a determination of the safety condition of the officers 114 on-scene based on the location of each of the officers 114 on-scene, officer in or out of vehicle status, any barriers between the K9 108 and the officers 114, etc. The method can cause a notifying of any of the officers 114 only if conditions are unsafe, along with providing associated details, a notifying of any of the officers 114 only if the K9 108 is "ready to be released" and unsafe conditions exist, a notifying of any of the officers 114 of potentially unsafe conditions when the K9 108 is on-scene, and/or a notifying of any of the officers 114 of potentially unsafe conditions when the K9 108 is "ready to be released." Again, "ready to be released" can be manually indicated by the K9 officer/handler 106, can be indicated by putting the leash on the K9 108 in the vehicle 110, can be indicated by voice detection, can be indicated by the K9 vehicle 110 stopping at the location of the incident (an indication that the K9 108 is soon to be released), or can be indicated by some other natural staging action. In an exemplary embodiment, "ready to be released" can be detected based on voice detection by the mobile device 140 and/or the vehicle modem 150 associated with the K9 officer/handler 106. Specifically, the K9 officer/handler 106 is supposed to announce his/her intention of releasing the K9 108 over the networks 102, 104 as standard operating procedure. So voice recognition is likely the most natural of ways to detect the "ready to be released" state. When the K9 officer/handler 106 arrives on scene (with/without vehicle), it can be enough to be a "ready to be released" indication if the suspect has not been apprehended yet. For example, the most likely release point can be calculated based on previous suspect known locations or current likely location of the suspect and the local geography (buildings, road intersections, etc.), thus indicating a best starting point for the release of the K9 108.

In yet another exemplary embodiment, the server 130 includes instructions for a program 316 to implement a method for determining a safe geofence in a K9 deployment scenario. This can include having all personnel (e.g., the K9 officer/handler 106 and the officers 114) and the vehicles 110, 112 report each of their locations to the server 130, having an in/out of vehicle status for all personnel, receiving information, such as video analysis and lidar, from distributed sensors on the vehicles 110, 112 or the personnel and the area sensors 116 that indicate or identifies barriers on-scene, receiving information from various information sources, such as satellite and the mapping data 132, that may be used to determine the location of buildings, vegetation, walls, etc. that would block the advance of the K9 108 in a given direction, determining geography such as hills/inclinations that would affect the speed of the K9 108, receiving information indicating the location of the K9 vehicle 110 and orientation of the door by which the K9 108 would be deployed, receiving information indicating the location of the K9 108, determining the probability of the K9 108 being at a given location taking into account all of the above within a certain amount of time, etc. The method can warn the officers 114 based on a probability map and the location of personnel, including a safer location that an officer could move to as well as sending a clear notification once the officers are safe.

FIG. 4 is a block diagram illustrates the mobile device 140 in accordance with some embodiments. The mobile device 140 can be a digital device that, in terms of hardware architecture, generally includes a processor 402, input/output (I/O) interfaces 404, a radio 406, a data store 408, and memory 410. It should be appreciated by those of ordinary skill in the art that FIG. 4 depicts the memory 410 in an oversimplified manner, and a practical embodiment may include additional components and suitably configured processing logic to support known or conventional operating features that are not described in detail herein. The components (402, 404, 406, 408, and 410) are communicatively coupled via a local interface 412. The local interface 412 can be, for example but not limited to, one or more buses or other wired or wireless connections, as is known in the art. The local interface 412 can have additional elements, which are omitted for simplicity, such as controllers, buffers (caches), drivers, repeaters, and receivers, among many others, to enable communications. Further, the local interface 412 may include address, control, and/or data connections to enable appropriate communications among the aforementioned components.

The processor 402 is a hardware device for executing software instructions. The processor 402 can be any custom made or commercially available processor, a central processing unit (CPU), an auxiliary processor among several processors associated with the memory 410, a semiconductor-based microprocessor (in the form of a microchip or chip set), or generally any device for executing software instructions. When the mobile device 140 is in operation, the processor 402 is configured to execute software stored within the memory 410, to communicate data to and from the memory 400, and to generally control operations of the mobile device 140 pursuant to the software instructions. In an exemplary embodiment, the processor 402 may include a mobile optimized processor such as optimized for power consumption and mobile applications. The I/O interfaces 404 can be used to receive user input from and/or for providing system output. User input can be provided via, for example, a keypad, a touch screen, a scroll ball, a scroll bar, buttons, bar code scanner, and the like. System output can be provided via a display device such as a liquid crystal display (LCD), touch screen, and the like. The I/O interfaces 404 can also include, for example, a serial port, a parallel port, a small computer system interface (SCSI), an infrared (IR) interface, a radio frequency (RF) interface, a universal serial bus (USB) interface, and the like. The I/O interfaces 404 can include a graphical user interface (GUI) that enables a user to interact with the memory 410. Additionally, the I/O interfaces 404 may further include an imaging device, i.e. camera, video camera, etc.

The radio 406 enables wireless communication to an external access device or network. Any number of suitable wireless data communication protocols, techniques, or methodologies can be supported by the radio 406, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Frequency Hopping Spread Spectrum; Long Term Evolution (LTE); cellular/wireless/cordless telecommunication protocols (e.g. 3G/4G, etc.); Land Mobile Radio (LMR); Digital Mobile Radio (DMR); Terrestrial Trunked Radio (TETRA); Project 25 (P25); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication. The data store 408 may be used to store data. The data store 408 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 408 may incorporate electronic, magnetic, optical, and/or other types of storage media.

The memory 410 may include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 410 may incorporate electronic, magnetic, optical, and/or other types of storage media. Note that the memory 410 may have a distributed architecture, where various components are situated remotely from one another, but can be accessed by the processor 402. The software in memory 410 can include one or more software programs, each of which includes an ordered listing of executable instructions for implementing logical functions. In the example of FIG. 4, the software in the memory 410 includes a suitable operating system (O/S) 414 and programs 416. The operating system 414 essentially controls the execution of other computer programs, and provides scheduling, input-output control, file and data management, memory management, and communication control and related services. The programs 416 may include various applications, add-ons, etc. configured to provide end user functionality with the mobile device 140. For example, exemplary programs 416 may include, but not limited to, a web browser, social networking applications, streaming media applications, games, mapping and location applications, electronic mail applications, financial applications, and the like.

The mobile device 140 can further include one or more sensors 420 communicatively coupled to the local interface 412. As described herein, the term sensors is used broadly to indicate anything that gathers situational or contextual data to relay this data to the server 130 for use in the methods and systems. The sensors 420 in the mobile device 140 can include, without limitation, a global positioning satellite (GPS) module or other type of location determining device, an accelerometer or other type of motion sensor, a gyroscope sensor, a magnetometer, and the like. The mobile device 140 can also communicate with other sensors local to the mobile device 140 such as vehicle-based sensors in the vehicles 110, 112 to incorporated data therefrom. For example, the mobile device 140 can receive data from sensors in the K9 vehicle 110 or in a K9 containment unit, i.e., an enclosure or section within the vehicle and containing the K9 108, of the K9 vehicle 110 to determine if the K9 is deployed or ready to deploy based on the door state. The sensors 420 are coupled to the processor 402 and associated data relative to operation of the methods and systems is relayed to the server 130 via the radio 406.

The vehicle modem 150 can include a similar architecture, from a functional perspective, as the mobile device 140 described in FIG. 4. However, the vehicle modem 150 is fixed within the vehicle 110, 112. Also, the radio 406 in the vehicle modems 150 is typically higher powered due to the availability of power from the vehicle 110, 112 (whereas the mobile device 140 relies on a local, chargeable battery and thus is designed to conserve power). The sensors 420 in the vehicle modem 150 can include door open/closed sensors, officer present sensors such as in the seat, K9 compartment open/closed sensors, etc.

The harness and/or collar 160 can also include a similar architecture, from a functional perspective, as the mobile device 140 described in FIG. 4. Of note, the harness and/or collar 160 would require a less intensive processor 402 to perform a select list of functions, may not require the I/O interfaces 404, and may include a smaller data store 408, and less memory 410. Specifically, the harness and/or collar 160 is less a general purpose computing device, compared to the mobile device 140 and the vehicle modem 150. The harness and/or collar 160 is configured to perform a select list of functions such as maintaining and relaying situational and contextual data from the sensors 420 to the server 130 about the K9 108.

Figure 5:
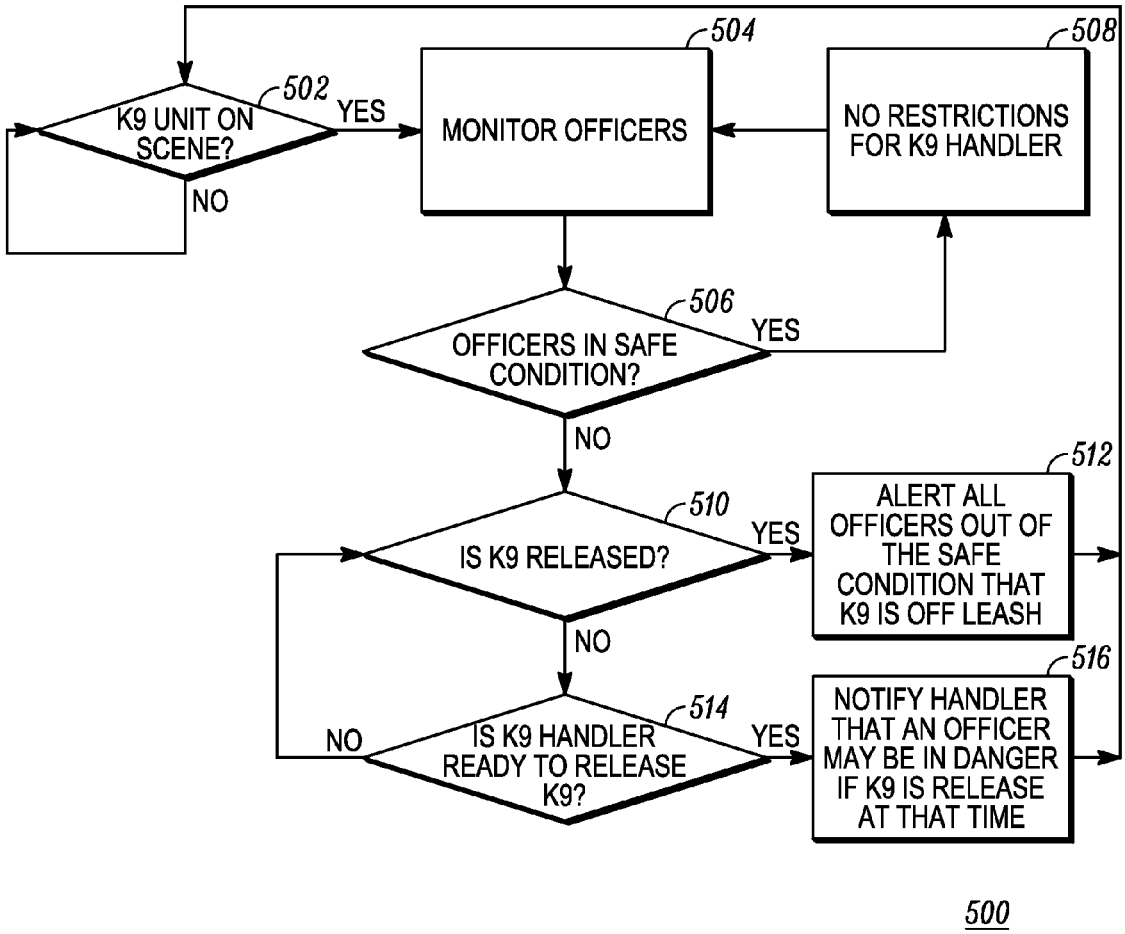
FIG. 5 is a flowchart of a method to alert a K9 handler when possible hazards between a K9 and other officers exists before release in a centrally controlled environment in accordance with some embodiments.

FIG. 5 is a flowchart of a method 500 to alert a K9 handler 106 when possible hazards between a K9 108 and other officers 114 exists before release in a centrally controlled environment in accordance with some embodiments. The method 500 contemplates operation by one or more devices (e.g., the server 130, the mobile devices 140, the vehicle modems 150, and/or the harness and/or collar 160) in the network 100. That is, the method 500 can be implemented in any system that includes location tracking, sensors 116 for detecting whether the officers 114 or a K9 108 are inside or outside of a vehicle, a K9 harness 160 that detects staging and release, mobile devices 140 tracking officer locations, sensors detecting opening the K9 vehicle compartment, mapping data to determine layout, barriers, etc., and the like. Again, the method 500 includes a determination of safe conditions, such as a geofence defining a safe-zone for officers based on location of the K9 on-scene, a direction and orientation of egress of the K9 if containment were released (e.g., door opened, unleashing), a determination of the safety condition of all officers on-scene based on the location of each officer on-scene, a determination of whether an officer is in or out of vehicle (i.e., in or out vehicle status) and/or whether there is a barrier between the K9 and the officer, and the like.

The method 500 begins once a K9 unit is on scene (step 502). The K9 unit can include the K9 108 with the K9 officer/handler 106 and/or the K9 vehicle 110. Once the K9 unit is on scene, the method 500 monitors all officers 114 (step 504). The monitoring includes collecting situational and contextual information from each of the officers 114 such as, for example, location, speed, direction, in/out of vehicle, running/walking/standing still, etc. The method 500 determines whether all of the officers 114 are in a safe condition (step 506). The safe condition determination includes a determination, based on configurable parameters, that the officers are out of a path of the K9 108, or in the path of the K9 but safe behind a barrier or in a vehicle, etc. If the officers are in a safe condition (step 506), the method 500 provides no restrictions to the K9 handlers 106 (step 508) and continues to monitor the officers 114 (step 506).

If one or more of the officers 114 are not in a safe condition (step 508), the method 500 checks if the K9 108 is released (step 510). If the K9 is released (step 510), the method 500 alerts all officers 114 that are not in a safe condition that the K9 is released, e.g., off leash (step 512), and returns to the step 502. The method 500 can also provide additional information to assist the officers who are out of the safe condition, such as directions to a safe condition, location in real-time of the K9, etc. If the K9 108 has not been released (step 510), the method 510 checks if the K9 handler 106 is ready to release the K9 (step 514). The "ready to release" can be determined as described herein. Again, "ready to be released" can be manually indicated by the K9 handler 106, can be indicated by putting the leash on the K9 108 in the vehicle 110, can be indicated by voice detection (of the K9 handler), can be indicated by the K9 vehicle 110 stopping at the location of the incident (an indication that the K9 108 is soon to be released), or can be indicated by some other natural staging action. If the K9 handler is not ready to release the K9 (step 514), the method 500 returns to the step 510. If the K9 handler 106 is ready to release the K9 108 (step 514), the method 500 notifies the K9 handler that an officer 114 may be in danger if the K9 is released at that time (step 516) and the method 500 returns to the step 502.

Dynamic geofence updates can be implemented independent of the method 500 and real-time updates to the geofence can be incorporated as the method 500 operates. Also, the method 500 is generally a central control method that can be implemented by the server 130 in the network 100. Note, the method 500 enables the K9 handler 106 to choose to hold the K9 108 or release it based on alerted risk. That is, the K9 handler 106 can still release the K9 108 if there are officers 114 that are not safe based on the K9 handler making an informed decision. For example, the method 500 can provide the K9 handler 106 with information about each officer in risk. Further, the method 500 can rate the risk on a scale based on a plurality of factors such as distance, speed, direction of travel, etc. of both the K9 108 and the officers 114.

Figure 6:
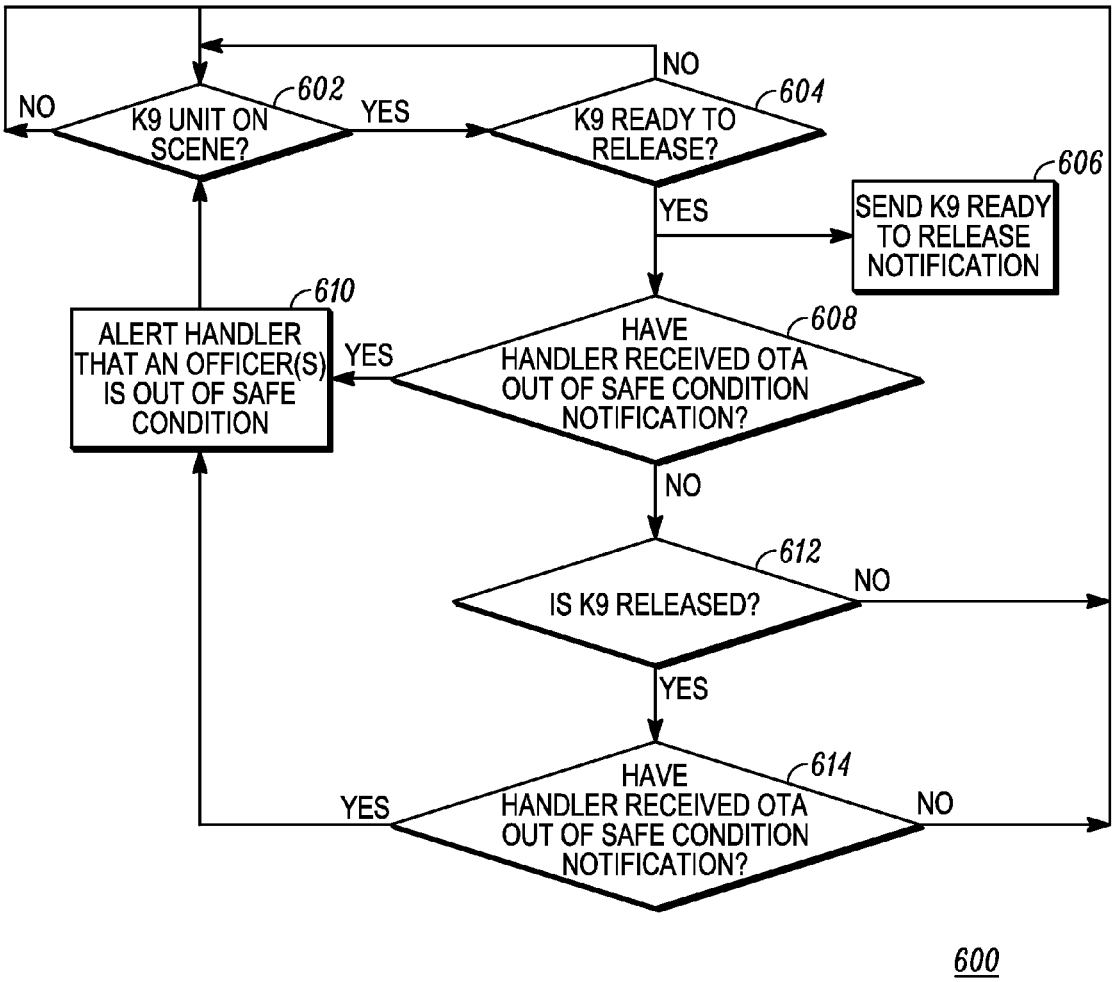
FIG. 6 is a flowchart of a method to alert a K9 handler when possible hazards between a K9 and other officers exists before release in a distributed controlled environment in accordance with some embodiments.
Figure 7:
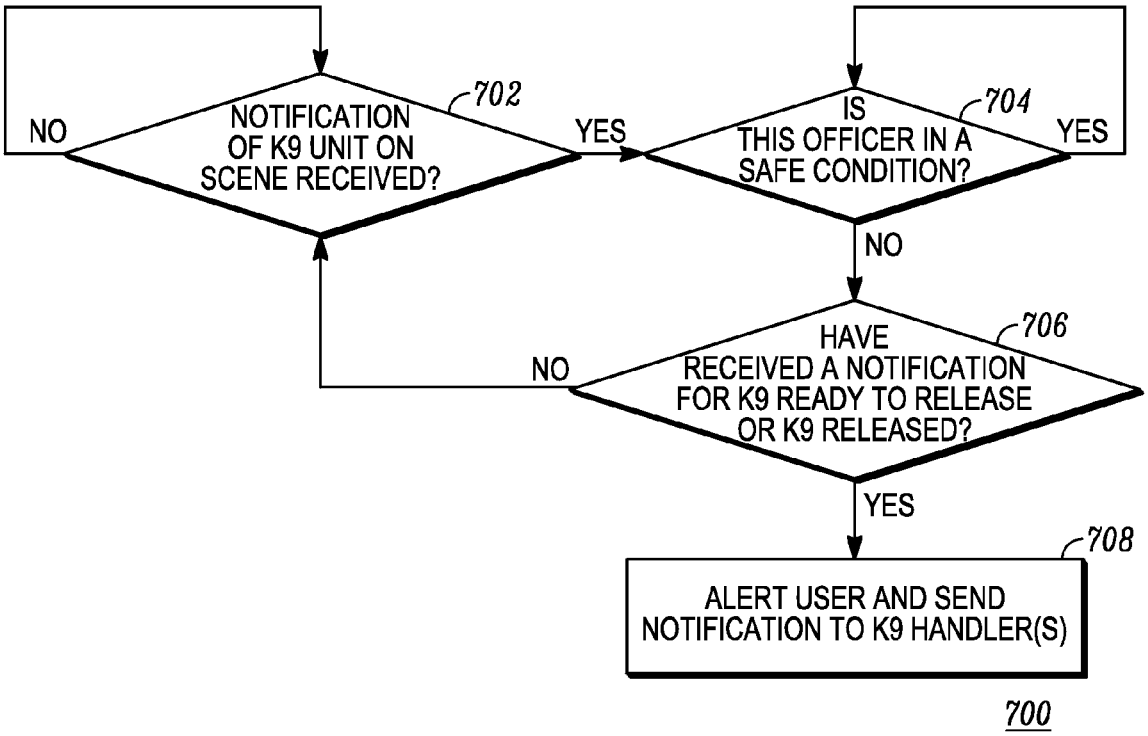
FIG. 7 is a method to alert an officer of a released or the pending release of a K9 in accordance with some embodiments.

FIG. 6 is a flowchart of a method 600 to alert a K9 handler 106 when possible hazards between a K9 108 and other officers 114 exists before release in a distributed controlled environment in accordance with some embodiments. FIG. 7 is a method 700 to alert an officer 114 of a released, or a pending release of, a K9 108 in the distributed controlled environment in accordance with some embodiments. The methods 600, 700 can be implemented together and the method 600 illustrates the K9 handler's 106 perspective whereas the method 700 illustrates the officer's 114 perspective. The methods 600, 700 contemplate operation by one or more devices (e.g., the server 130, the mobile devices 140, the vehicle modems 150, and/or the harness 160) in the network 100. That is, the methods 600, 700 can be implemented in any system that includes location tracking, sensors for detecting in/out of vehicle of officers 114 and the K9 108, a K9 harness 160 that detects staging and release, mobile devices 140 tracking officer locations, sensors 116 detecting opening of a containment unit of the K9 vehicle 110, mapping data to determine layout, barriers, etc., and the like. Again, the methods 600, 700 include a determination of safe conditions, such as a geofence defining a safe-zone for officers 114 based on location of the K9 108 on-scene, a direction and orientation of egress of the K9 if containment were released (door opened, unleashing), a determination of the safe condition of all officers 114 on-scene based on the location of each officer on-scene, an officer 114 in or out of vehicle status, a barrier between the K9 and the officer, and the like.

The methods 600, 700 can be implemented in any system that includes the determination of safe-zones for officers based on a location of a K9 108 on-scene, direction and orientation of egress of K9 if containment were released (door opened, unleashing); the determination of the safe conditions of the officers 114 on-scene based on the associated locations, an officer in or out of vehicle status, a barrier between the K9 and the officer, etc.; the notification of an officer only if conditions are unsafe; the notification of an officer only if the K9 is "ready to be released" and unsafe; the notification of an officer of potentially unsafe conditions when the K9 is on-scene; and/or the notification of an officer of potentially unsafe conditions when the K9 is "ready to be released." Note, geofence updates can be implemented independent of the methods 600, 700 and real-time updates to the geofence can be incorporated as the methods 600, 700 operate.

The method 600 begins once the K9 unit (e.g., the K9 108 with the K9 officer/handler 106 and/or the K9 vehicle 110) is on scene (step 602). The method 600 checks if the K9 108 is ready to be released (step 604). The "ready to release" can be determined as described herein. Again, "ready to be released" can be manually indicated by the K9 handler, can be indicated by putting the leash on the K9 108 in the vehicle 110, can be indicated by voice detection, can be indicated by the K9 vehicle 110 stopping at the location of the incident (an indication that the K9 108 is soon to be released), or can be indicated by some other natural staging action. If the K9 108 is not ready to be released (step 604), the method 600 returns to the step 602. If the K9 108 is ready to be released (step 604), the method 600 can send a "K9 ready to be released" notification (step 606) and check if the K9 handler 106 has received any over-the-air (OTA) out of safe condition notifications (step 608). Since the method 600 is distributed, the K9 handler 106 receives out of safe condition notifications directly from the officers 114 on scene.

If there are officers 114 not in (i.e., out of) the safe condition (step 608), the method 600 alerts the K9 handler 106 that one or more officers are out of the safe condition (step 610) and the method 600 returns to the step 602. The method 600 can also provide other data to the K9 handler 106 so that the K9 handler can evaluate whether or not to release the K9 108. Again, this can include rating the risk of the officers out of the safe condition on a scale based on a plurality of factors such as distance, speed, direction of travel, etc., of both the K9 108 and the officers 114. If there are not officers 114 out of the safe condition (step 608), the method 600 checks if the K9 108 is released (step 612), and if not, the method 600 returns to the step 602. If the K9 108 is released (step 612), the method 600 checks if the K9 handler 106 has received over-the-air (OTA) out of safe condition notifications (step 614), and if not, the method 600 returns to the step 602. If the K9 handler 106 receives OTA out of safe condition notifications (step 614), the method 600 returns to the step 610.

The method 700 initiates based on receiving a notification of a K9 unit on scene (step 702). If the method 700 receives the notification (step 702), the method 700 checks if an officer 114 is in a safe condition (step 704). The determination of the safe condition, in this distributed environment, can be made locally by the officer's 114 mobile device 140 based on information in the notification. The method 700 continues to check if the officer 114 is in the safe condition (step 704), and if the method 700 determines the officer is not in the safe condition (step 704), the method 700 checks if a notification that a K9 is ready to be released or has been released has been received (step 706), and if not, the method 700 returns to the step 702. If the notification that a K9 is ready to be released or has been released has been received (step 706), the method 700 can alert the user and send a notification to the K9 handler 106 (step 708).

In addition to the foregoing methods 500, 600, 700, the methods and systems can include a method to continually define and broadcast a safe zone, i.e., a geofence. The geofence can be determined by the server 130 or in a distributed fashion. This includes having all personnel and vehicles report location to the server 130; having in/out of vehicle status of all personnel reported to the server 130; performing video analysis and lidar from distributed sensors on vehicles or persons to report other barriers on-scene; having various information sources including satellite and the mapping data; determining locations of buildings, vegetation, walls, etc. (i.e., obstacles) that would block advance of the K9 in a given direction; determining geography, such as hills/inclinations that would affect the speed a K9 could move at; determining a location of the K9 vehicle and an orientation of the vehicle door by which the K9 would be deployed; determining a location of the K9; determining a probability of the K9 being at a given location taking into account all of the above, within a certain amount of time; and warning the personnel based on the probability map and the location of personnel, including a safer location that the personnel could move to. This can also include sending a "clear" notification when personnel is safe from being unsafe.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method to increase protection of personnel during K9 deployments, comprising:

receiving contextual and situational data from a plurality of mobile devices associated with a plurality of officers at a scene, a mobile device associated with a K9 handler at the scene, and a device associated with a K9 at the scene, wherein each of the mobile devices and the device are communicatively coupled to one or more networks;

determining safety conditions of each of the plurality of officers based on the contextual and situational data; and notifying the K9 handler via the associated mobile device of any of the plurality of mobile devices being in the unsafe condition when about to release the K9 or after such that the K9 is recalled, based on the determining.

2. The method of claim 1, further comprising:

maintaining a dynamic geofence addressing safety and risk of the plurality of officers relative to the K9.

3. The method of claim 2, wherein the dynamic geofence takes into account any of:

an officer of the plurality of officers being in a location in or behind a barrier comprising a vehicle or object at a known location thereby safe from the K9 regardless of location;

an officer of the plurality of officers being a defined distance behind the K9;

an officer of the plurality of officers having a proximity to the K9 greater than a defined amount regardless of direction;

a movement direction of the K9 based on the contextual and situational data; and a movement direction of an egress of the K9 out of a vehicle or confinement.

4. The method of claim 2, further comprising:

determining an officer of the plurality of officers is at risk based on the dynamic geofence;

determining the officer is within a vehicle based on sensors associated with the officer's mobile device or sensors associated with the vehicle; and preventing notifying to the officer that the officer is at risk based on the officer being in the vehicle.

5. The method of claim 4, wherein determining whether each of the plurality of officers is in a safe condition comprises detecting that the officer within the vehicle is exiting the vehicle and wherein notifying comprises:

in response to detecting that the officer is exiting the vehicle, notifying the officer and the K9 handler, via associated mobile devices, of unsafe conditions.

6. The method of claim 1, wherein determining whether each of the plurality of officers is in a safe condition comprises:

determining whether each of the plurality of officers is in a safe condition based on one or more the contextual and situational data comprising of location tracking for each of the plurality of officers and the K9, sensors for detecting whether or not each of the plurality of officers is in a vehicle, the device on the K9 detecting staging and releasing, sensors detecting opening of a K9 compartment, and mapping data associated with the scene.

7. The method of claim 6, further comprising:

performing the determining and the notifying after detecting a ready to release state of the K9, wherein the ready to release state is determined one of manually, by putting a leash on the K9, by voice detection on the mobile device of the K9 handler, if a suspect has not been apprehended when the K9 arrives, and by another natural staging action.

8. The method of claim 7, further comprising:

in response to determining that an officer of the plurality of officers is not in a safe condition, notifying the K9 handler of unsafe conditions, thereby enabling the K9 handler to decide whether or not to release the K9.

9. The method of claim 1, further comprising:

utilizing one or more sensors and mapping data to determine locations of obstacles that would block advance of the K9 in a given direction;

utilizing the one or more sensors and mapping data to determine geography comprising hills or inclinations that would affect speed a K9 could move at; and incorporating the locations of obstacles and the geography in the determining of whether each of the plurality of officers is in a safe condition.

10. The method of claim 1, wherein the method is implemented in a server communicatively coupled to the mobile devices and the device associated with the K9 via the one or more networks.

11. The method of claim 1, wherein the method is implemented in a distributed fashion between the mobile device associated with the K9 handler, the mobile devices of the plurality of officers, and the device associated with the K9.

12. A server, comprising:

a network interface, a data store, and a processor, each communicatively coupled therebetween; and memory storing instructions that, when executed, cause the processor to:

receive, via the network interface, contextual and situational data from a plurality of mobile devices associated with a plurality of officers at a scene, a mobile device associated with a K9 handler at the scene, and a device associated with a K9 at the scene, wherein each of the mobile devices and the device are communicatively coupled to the network interface through one or more networks;

determine safety conditions of each of the plurality of officers based on the contextual and situational data; and notify the K9 handler via the associated mobile device of any of the plurality of mobile devices being in the unsafe condition when about to release the K9 or after such that the K9 is recalled, based on the determined safety conditions.

13. The server of claim 12, wherein the memory is configured to store instructions that, when executed, further cause the processor to:

maintain and update a dynamic geofence addressing safety and risk of the plurality of officers relative to the K9.

14. The server of claim 13, wherein the memory storing instructions that, when executed, further cause the processor to:

determine an officer of the plurality of officers is at risk based on the dynamic geofence;

determine the officer is within a vehicle based on sensors associated with the officer's mobile device or sensors associated with the vehicle; and prevent notifying to the officer that the officer is at risk based on the officer being in the vehicle.

15. The server of claim 14, wherein the memory is configured to store instructions that, when executed, cause the processor to determine whether each of the plurality of officers is in a safe condition by detecting that the officer within the vehicle is exiting the vehicle based on the contextual and situational data and wherein the memory stores instructions that, when executed, further cause the processor to:

in response to detecting that the officer is exiting the vehicle, notify the officer and the K9 handler via associated mobile devices of unsafe conditions.

16. The server of claim 12, wherein the memory is configured to store instructions that, when executed, cause the processor to determine whether each of the plurality of officers is in a safe condition based on one or more the contextual and situational data comprising location tracking for each of the plurality of officers and the K9, sensors for detecting whether or not each of the plurality of officers are in a vehicle, the device on the K9 detecting staging and releasing, sensors detecting opening of a K9 compartment, and mapping data associated with the scene.

17. The server of claim 16, wherein the memory storing instructions that, when executed, further cause the processor to:

perform the determine and the notify after detecting a ready to release state of the K9, wherein the ready to release state is determined one of manually, by putting a leash on the K9, by voice detection on the mobile device of the K9 handler, if a suspect has not been apprehended when the K9 arrives, and by another natural staging action.

18. The server of claim 17, wherein the memory is configured to store instructions that, when executed, further cause the processor to:

in response to determining that an officer of the plurality of officers is not in a safe condition, notify the K9 handler of unsafe conditions based on the determining and associated risk information, thereby enabling the K9 handler to decide whether or not to release the K9 based on the associated risk information.

19. The server of claim 12, wherein the memory is configured to store instructions that, when executed, further cause the processor to:

utilize one or more sensors and mapping data to determine locations of obstacles that would block advance of the K9 in a given direction;

utilize the one or more sensors and the mapping data to determine geography comprising hills/inclinations that would affect speed a K9 could move at; and incorporate the locations of obstacles and the geography in the determining of whether each of the plurality of officers is in a safe condition.

20. A public safety network, comprising:

a plurality of mobile devices each associated with an officer;

a K9 handler mobile device;

a harness or collar disposed to a K9;

a server communicatively coupled to the plurality of mobile devices, the K9 handler mobile device, the harness and/or collar, and a vehicle modem;

wherein the server is configured to:

notify any of the plurality of mobile devices of an unsafe condition and associated details relative to the K9; and notify the K9 handler mobile device of any of the plurality of mobile devices being in the unsafe condition when about to release the K9 or after such that the K9 is recalled, wherein the unsafe condition is based on situational and contextual data provided to the server by the plurality of mobile devices, the K9 handler mobile device, and the harness or collar.

* * * * *